US009293272B1

(12) United States Patent
Lechner

(10) Patent No.: US 9,293,272 B1
(45) Date of Patent: Mar. 22, 2016

(54) FUSE TO CIRCUIT BREAKER ADAPTER

(71) Applicant: Kevin Phillippe Lechner, Wurtsboro, NY (US)

(72) Inventor: Kevin Phillippe Lechner, Wurtsboro, NY (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 282 days.

(21) Appl. No.: 13/998,746

(22) Filed: Dec. 3, 2013

(51) Int. Cl.
*H01H 9/00* (2006.01)

(52) U.S. Cl.
CPC ..... *H01H 9/00* (2013.01)

(58) Field of Classification Search
CPC ..... H01H 9/00; H01H 71/02; H01H 9/10; H01H 9/102; H01H 9/104; H01H 9/106
USPC ..... 200/284, 50.07, 50.27; 337/37, 66, 187, 337/142–146
See application file for complete search history.

(56) References Cited

U.S. PATENT DOCUMENTS

| | | | | |
|---|---|---|---|---|
| 3,668,483 | A | 6/1972 | Kellenbenz | |
| 4,346,424 | A | 8/1982 | Hansen | |
| 6,717,505 | B1 * | 4/2004 | Bruchmann | H01H 85/32 337/187 |
| 8,089,335 | B2 * | 1/2012 | Darr | H01H 9/104 337/143 |

FOREIGN PATENT DOCUMENTS

FR 2627010 A1 2/1989

OTHER PUBLICATIONS

Navedtra 14175, Electrical and Electronic Circuit Analysis of, p. 90, Fig 2-1, p. 104, Fig 2-14.
The Pollak: 3OAMP—Maxi—Style Type III Push button Reset Circuit Breaker, http://www.dllbatterysalesandservice.com/browe.cfm/4,7302.html.
Glass Fuse Type, Snapin Mounting—Non-Gyelins modified Reset Designed, http://products.pollakaftermarket.com/Hem/circuit-breakers--1034/e-type-snap-in-mounting-non-cycling-modifield-reset.

* cited by examiner

*Primary Examiner* — Amy Cohen Johnson
*Assistant Examiner* — Marina Fishman
(74) *Attorney, Agent, or Firm* — Frederic J. Zimmerman

(57) ABSTRACT

A circuit breaker adapter is disclosed for use in a fuse holder therein replacing a blade type fuse. The adapter includes a housing and a modified circuit breaker where pronged terminals are pivotally attached conductive articulable extensions. The housing is a contiguous block of material that receives the modified circuit breaker and gripping clips of the fuse holder. The housing has a center chute shaped section that holds the circuit breaker. In particular, the inside of the housing has a pair of accessible open cavities to receive the extensions similar to many fuses. The circuit breaker literally plugs into sockets on the housing, and the extensions are rotated outward into one of the accessible open cavities. The adapter may be placed into the fuse holder.

20 Claims, 4 Drawing Sheets

FUSE TO CIRCUIT BREAKER ADAPTER

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to protective electrical circuit devices and more particularly to a circuit breaker adapter that enables a circuit breaker to be utilized in a fuse holder.

2. Background

The United States Navy and Coast Guard have a number of combat ships fitted with highly automated guns that utilize an electrically powered gun mount to control the gun. The Mark gun (MK-75) is a three-inch gun with a range of ten 10 nautical miles and can fire up to eighty rounds per minute. The high level performance guns are lightweight and have low manning requirements. The Mk-75 is well suited for installation on smaller combat vessels, frigates and cutters.

The first United States produced gun mount for the MK-75 was delivered in August 1978. Currently, MK-75 guns are on some guided missile frigates and some Navy hydrofoils. The Coast Guard's cutters are equipped with automated guns MK-75 guns, where the gun mount is remotely controlled. The gun mounts control the train and elevation of the gun, and the protective electrical devices that are a part of the electrically powered gun mount systems are starting to exhibit signs of aging, as evidenced by a higher incidence of blown fuses. This spike in demand has depleted the entire government stock of these legacy parts, which are SCR fuses. Furthermore, the cost and the time to replace are unacceptably too long and high in cost. The United States Navy and Coast Guard need a timely and cost effective solution to keep the electrically powered gun mounts operational.

SUMMARY OF THE INVENTION

The disclosed invention is an adapter that enables a circuit breaker to be installed in place of a fuse in a fuse holder on a vessel and in any other suitable application. Installation of a new fuse is commonly referred to "plug and play", where a blown fuse is pulled-out of a pair of electrically conductive gripping clips in a fuse holder and the new fuse is pushed-in the pair of clips, therein reestablishing a closed, working, protected electrical circuit. One advantage of a circuit breaker is that with an overage current, the circuit breaker trips protecting the circuit but unlike a blown fuse, which must be replaced, the tripped circuit breaker only needs to be reset. Some circuit breakers are self-resetting.

Another advantage of the invented adapter is that the existing fuse panels may be used, obviating the cost and time needed to install a circuit breaker panel. The option to rewire gun control panels to accommodate circuit breakers is obviated. Installing a circuit breaker panel requires a lot of time, effort, and money.

An aspect of the invention is that the adapter is suitable for a single fuse holders and fuse holders that may hold a plurality of fuses. The adapter permits the simultaneous use of both circuit breakers and fuses. A fuse holder has an electrically insulating plate with one or more insular elongate bays, wherein each bay has a pair of clamping fuse clips. A common variation of a fuse clip has a pair of opposing electrically conductive contacts for clamping a knife-blade-end of a fuse. A fuse with a blade element, for example, an SCR fuse, includes a center section that is an elongate cylindrical element and a pair of outboard elongate sections that are similar in shape to a blade. The blade element has an overall length that extends lengthwise through the cylindrical element. The blade element has a center fusible portion that is enclosed within the cylindrical element. The elongate sections have a blade thickness, and the elongate sections project from opposing ends of the center elongate cylindrical element.

The fuse is positioned in the fuse holder by forcing the blade element into the clips, causing each clip to springedly widen as it receives the elongate section of the blade element. A gripping force is generated by the clips on the blade element, securing the fuse in the bay of the fuse holder.

The invented adapter enables the use of a minimally modified circuit breaker in a legacy fuse holder. The circuit breaker has a first pronged terminal and a second pronged terminal spaced by a separation length. A first arcuate conductive articulable extension is pivotally attached to the first pronged terminal. A second arcuate conductive articulable extension is pivotally attached to the second pronged terminal. The articulable extensions may be pivoted outwardly from an assembly position where they are closely aligned with the pronged terminals to a use position. The articulable extensions are nearly orthogonal to the pronged terminals, and aligned to be nearly longitudinal. The arcuate conductive articulable extensions have an individual thickness that is comparable to the thickness of the elongate sections of the blade element and an individual length that cumulatively spans a distance comparable to the overall length of the fuse minus the separation length of the pronged terminals. Depending on the selection of the circuit breaker, the individual length of the articulable extensions is usually about the length of the elongate sections of the blade element. The articulable extensions are arcuate to permit pivoting from the assembly position to the use position.

The adaptor further includes an electrical insulating chute shaped housing, where the housing is a contiguous block of material that receives the modified circuit breaker with the articulable extensions and the gripping clips. The housing has a first accessible open cavity and a second accessible open cavity, where each accessible open cavity is open on a bottom side (the bottom side of the housing covers the clips mounted on the fuse holder's electrically insulating plate). Each accessible open cavity is sufficiently large to accommodate a clip gripping an articulable extension. The top side of the housing is chute shaped, and it has two slotted sockets, where their center points are spaced by the separation length. Each socket extends to one of the accessible open cavities. The sockets provide passages large enough to accommodate the articulable extensions and terminals in the assembly position.

The circuit breaker adapter is assembled by plugging the articulable extensions into sockets in the chute shaped portion of the housing. The modified circuit breaker is seated in the chute section of the housing and the articulable extensions are protruding from the bottom side of the housing. Assembly is completed by pivoting the articulable extensions outboard to the use position, into the accessible open cavities of the housing. The chute shaped housing is locked onto the circuit breaker, and the extensions are positioned to engage the clips on a fuse holder. The housing has an overall length that may span the entire length of the bay of the fuse holder, but this extra length is generally not required.

Another advantage of the invented circuit breaker adapter is that a tripped reset button may be reset without removing the circuit breaker adapter or cutting off the power.

BRIEF DESCRIPTION OF THE DRAWINGS

The foregoing invention will become readily apparent by referring to the following detailed description and the appended drawings in which.

DETAILED DESCRIPTION OF THE INVENTION

Figure 1:
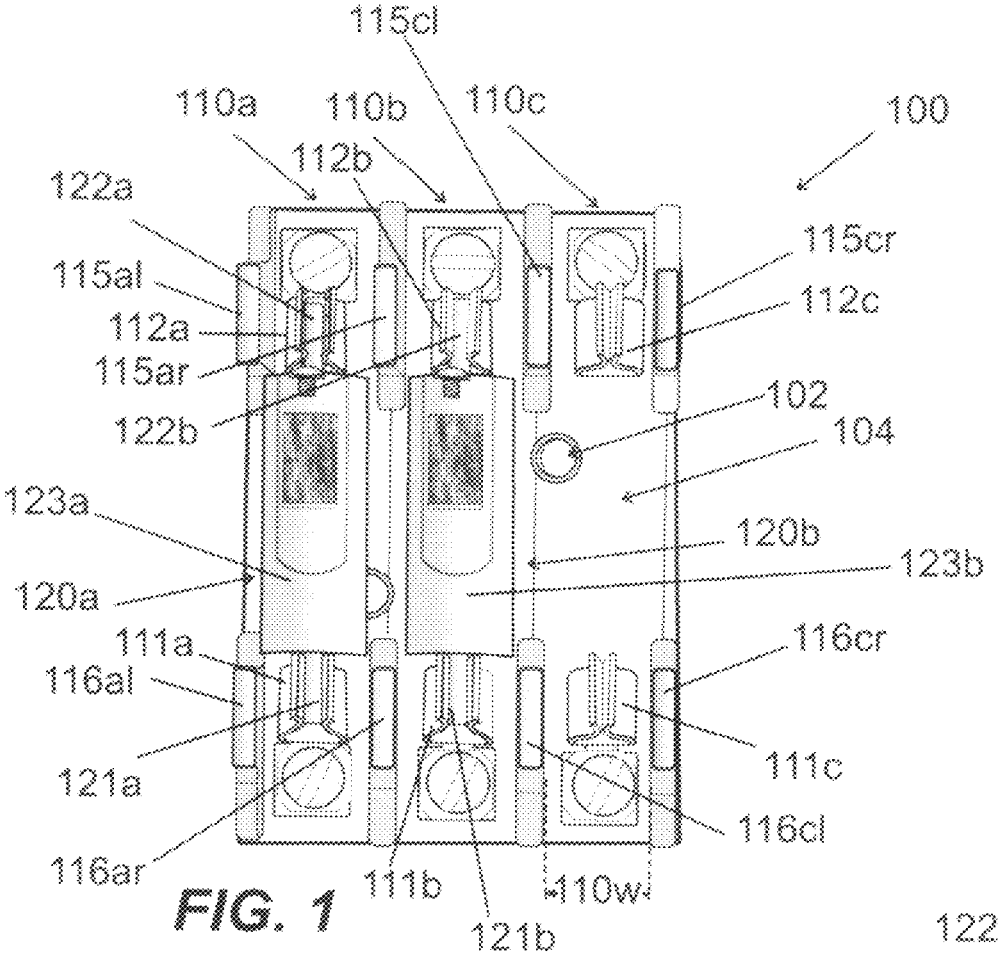
FIG. 1 (Prior Art)
FIG. 1 is an elevated plan view of a conventional legacy fuse holder that can hold up to three fuses, where currently there are two fuses, each fuse in a bay having a pair of clamping fuse clips, where each clip grips an end of a blade section therein securing the fuse.

The invented adapter enables a circuit breaker to be installed in place of a conventional fuse in a conventional fuse holder. In an exemplary embodiment, the circuit breaker has planar pronged terminals that protrude from a side of the circuit breaker. The circuit breaker has a thickness that is narrow enough to fit in a bay of a fuse holder. The prior art, as shown in FIG. 1, illustrates a conventional fuse holder 100 that may hold up to three fuses 120 (see FIG. 2), and in the instant case the holder has two fuses. In the illustrated fuse holder, there are only two fuses 120*a*,120*b* in the holder 100 so that the reader can better understand the art. The fuse holder 100 has three bays 110*a*,110*b*,110*c*. The outside bays 110*a*, 110*c* are nearly mirror images, differing only in the location of the fuse holder fastening hole 102 in the base plate 104. Outside bay 110*a* has an upper left insulator 115*a*1 and a lower left insulator 116*al*. Outside bay 110*c* has an upper right insulator 115*cr* and a lower right insulator 116*al*. Bays 110*b* and 110*c* share an upper left insulator 115*c*1 and a lower left insulator 116*c*1. Bays 110*a* and 110*c* share an upper right insulator 115*cr* and a lower right insulator 116*cr*. Each bay has a width that is about 110*w*. In the applicant's illustrated invention there is additional insulation for each bay, and the additional insulation is not shared, irrespective of the number of fuse bays.

Figure 2:
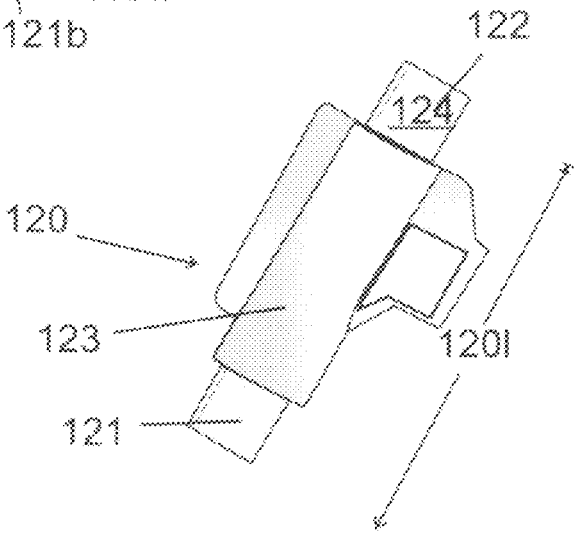
FIG. 2 (Prior Art)
FIG. 2 is an elevated view of a conventional n SCR fuse with a conductive blade that functions in part as a structural element for the SCR fuse.

In the illustrated fuse holder 100 bay 110*c* has two clamping clips 111*c*, 112*c* that are ready to receive the fuse 120 with knife-blade-ends 121,122 (FIG. 2). Both of the clamping clips 111*c*,112*c* are springedly closed. In the other two bays 110*a*,110*b* the clips 112*a*, 111*a* and 112*b*, 111*b* are gripping and securing fuses 120*a*,120*b*. The clips 112*a*, 111*a* and 112*b*, 111*b* are springedly widened. In the case of clips 112*a*, 111*a* and 112*b*, 111*b* the fuses' blade sections 121*a*,122*a*, 121*b*,122*b* have a thickness that determines how far the clips 112*a*, 111*a* and 112*b*, 111*b* are widened. Widening causes the clips to tighten their grip on the blade elements.

The fuse 120 shown in FIG. 2 and FIG. 1 has a blade element 124 with sections 121,122. The illustrated fuse may be an SCR fuse. It includes a center section 123 which is substantially an elongate cylindrical element. The outboard elongate sections 121,122 are similar in shape to a blade. The blade element has an overall length 1201 that extends lengthwise through the cylindrical element. The blade element 124 has a center fusible portion that is enclosed within the cylindrical element 123, which may be made of glass.

Figure 3:
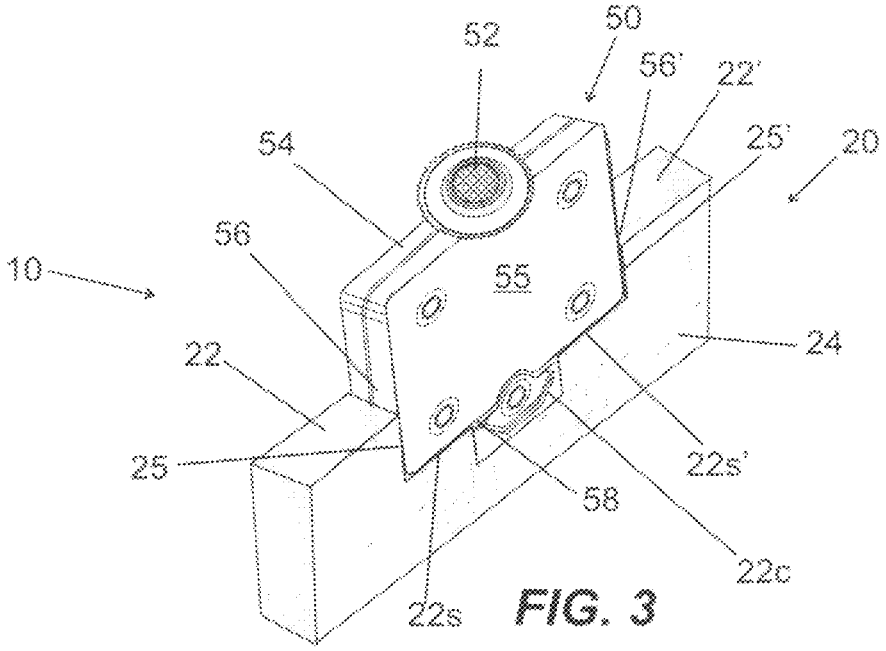
FIG. 3 is an elevated perspective view of a circuit breaker fitted with a circuit breaker adapter that enables a modified circuit breaker to be utilized in a fuse holder.

The fuse may be replaced by an inventive circuit breaker adapter shown in FIG. 3, where the circuit breaker adapter may be utilized in a fuse holder. In an exemplary embodiment, the circuit breaker adapter 10 includes a modified circuit breaker and a housing 20 with a bottom that may receive the fuse holder clips. The modified circuit breaker 51 is seated in a chute section of the housing 20. The chute portion of the housing 20 has a right wall 25', a left wall 25, a right ledge 22*s*', a left ledge 22*s*, a lower second right wall 25*s*', a lower second left wall 25*s*, and a floor 22*f*. A bottom side 58 of the modified circuit breaker 50 is supported by the chute's right ledge 22*s*' and the chute's left ledge 22*s*, spanning a lower channel 22*c* having a floor 22*f* (see FIG. 7*a*). A portion of the circuit breaker's left wall 56 is lodged against the chute's left wall 25, and a portion of the circuit breaker's right wall 56' is lodged against the chute's right wall 25'. The circuit breaker has a reset button 52.

Figure 6B:
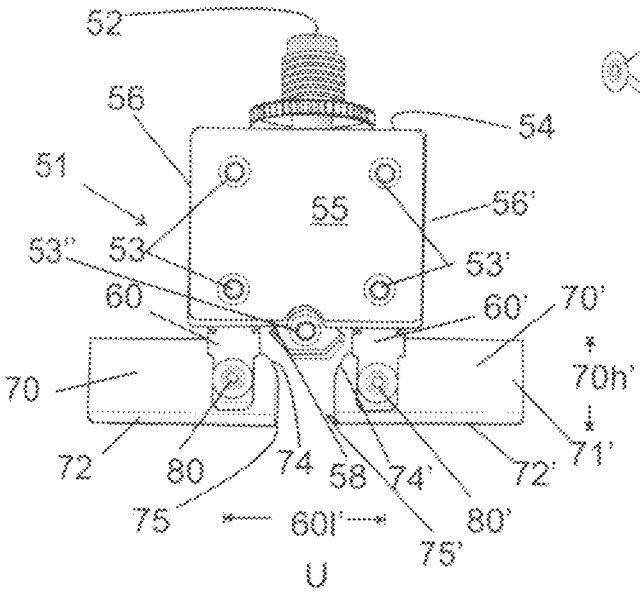
FIG. 6*b* is a frontal view of the modified circuit breaker shown in the use position (U), wherein the arcuate conductive articulable extensions are pivotally rotated out board to a use position where the articulable extensions are nearly orthogonal to the pronged terminals, and closely aligned as to be nearly longitudinal.

As shown in FIG. 6*b*, the illustrated circuit breaker is held together with rivets 53, 53' and 53". As shown in FIG. 3, rivet assembly 53" extends below the front plate 55 from the bottom side 58 into the lower channel 22*c*. The rivet assembly 53" extends between the lower second right wall 25*s*' and the lower second left wall 25*s* toward the floor 22*f* of the chute.

Figure 4:
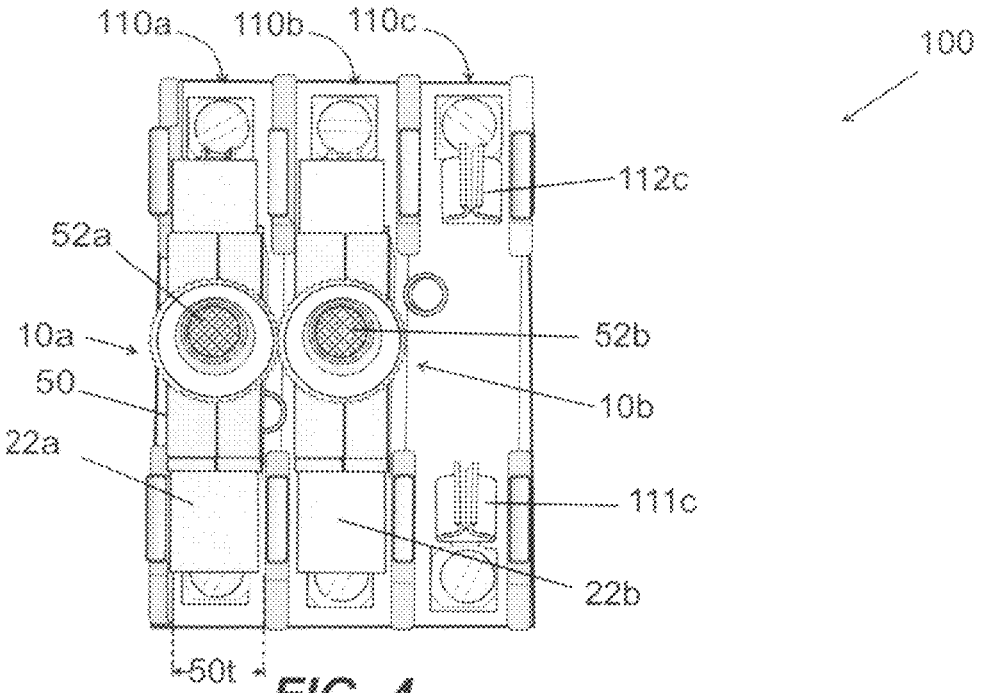
FIG. 4 is an elevated plan view of a three bay fuse holder, as shown in FIG. 1, that is currently holding two circuit breakers, each of which are fitted with a circuit breaker adapter enabling the circuit breakers to be utilized instead of or in combination with fuses having a blade.

FIG. 4 illustrates the fuse holder shown in FIG. 1, which in one exemplary variation is a Bussmann™ sfb1060-03 buss fuse block. The width of a bay 110*w*, as shown in FIG. 1, and the thickness of the circuit breaker 50*t* are approximately the same. The circuit breaker may be slightly thicker as it is elevated above the fuse holders' insulation walls 115*al*-*cr*, 116*al*-*cr*. Note, that in FIG. 4, in bays 110*a* and 110*b*, the circuit breaker adapters 10*a*,10*b* cover the clips. Only clips

111*c*, 112*c* are visible, and ready to receive the circuit breaker adapter 10*c* (not specifically shown).

Figure 5:
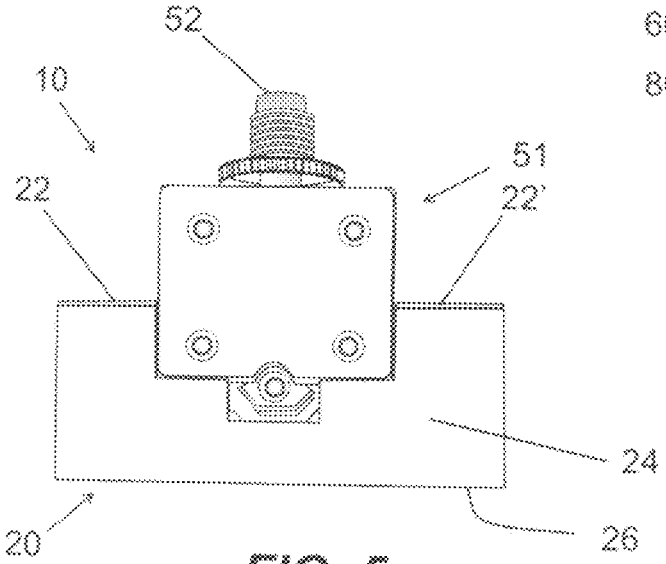
FIG. 5 is a frontal view of a circuit breaker adapter.

A frontal view of the circuit breaker adapter having a modified circuit breaker is shown in FIG. 5.

Figure 6C:
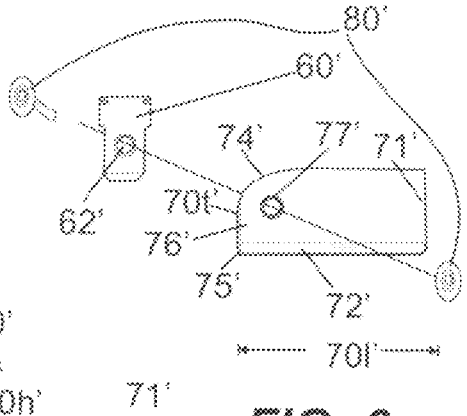
FIG. 6*c* is an exploded view of an articulable extension, a pronged terminal, and a rivet.
Figure 6A:
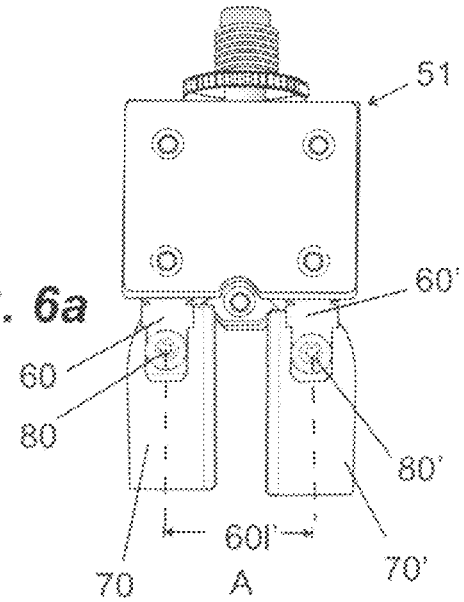
FIG. 6*a* is a frontal view of a modified circuit breaker having extensions that are shown in the assembly position (A), where the extensions are closely aligned with the pronged terminals, where a first arcuate conductive articulable extension is pivotally attached to the first pronged terminal, and a second arcuate conductive articulable extension is pivotally attached to the second pronged terminal.

As illustrated in FIG. 6*a*, a circuit breaker is modified to have extensions 70,70'. Brass is known to be suitable material. After modification the circuit breaker is renumbered to 51 reflecting the modifications. The modifications result in a pivotally attached first arcuate conductive articulable extension 70 to the first pronged terminal 60, and a pivotally attached second arcuate conductive articulable extension 70' to the second pronged terminal 60'. An exploded view is shown in FIG. 6*c* of second arcuate conductive articulable extension 70'. The articulable extension 70' is broadly similar to the fuse blade sections 121,122*a* shown in FIG. 2, however there are major departures. In FIG. 6*c*, the articulable extension 70' has a length 70*l'*, a thickness 70*t'*, an inboard hole 77' near an inboard end 76' adjacent to an acruate edge 74', a beveled corner 75', and a tapered edge 72 that extends from the inboard end 76' to an outboard end 71'. The inboard hole 77' is axial to a terminal hole 62' in the pronged terminal 60'. A fastening element 80' axially connects the extension 70' and the terminal 60', permitting friction rotation.

Returning to FIG. 6*a*, extension 70 is similarly attached to terminal 60. The length between the points of attachment is 80 to 80' is indicated by 601. This length is a separation length, which is about the distance between the center points 27*c*, 27*c'* of sockets 27, 27' as illustrated in FIG. 7*b*. As shown in FIG. 6*b*, the arcuate corners 74,74' permit rotation of the extensions 70,70' without impinging either the bottom side 58 or the rivet assembly 53" of the circuit breaker. As shown in FIG. 6*a*, the extensions 70,70' are in the assembly position (A).

In FIG. 6*b*, the articulable extensions 70,70' are in the use position (U). When an extension is rotated in the socket 27,27' during the transition (T) the corner 75,75' of the extension 70,70' could impact the wall 25*s*,25*s'*(see FIG. 7*a*) or a wall 29,29' in the accessible open cavity as shown in FIG. 7*d*. To prevent impact, the corners 75,75' may be beveled to a point where they are rounded.

FIG. 6*b* illustrates the modified circuit breaker 51 with the extensions in the use position. The housing 20 would normally prevent this view.

Figure 7A:
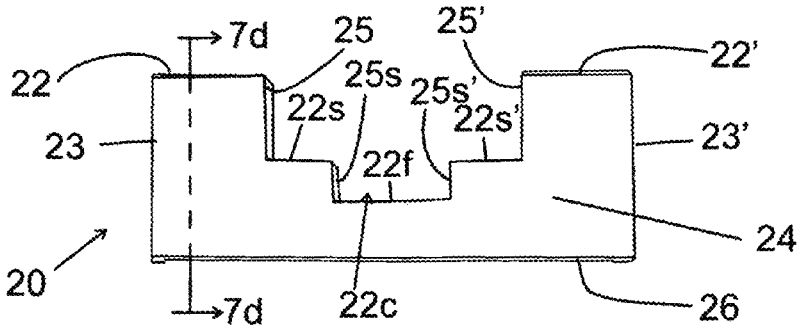
FIG. 7*a* is a plan view of a front side of the adapter's electrical insulating chute shaped housing, that insulates and supports the modified circuit breaker and the housing has accessible open cavities that are sufficiently large to accommodate springedly widened clips gripping articulable extensions in the use position.
Figure 7B:
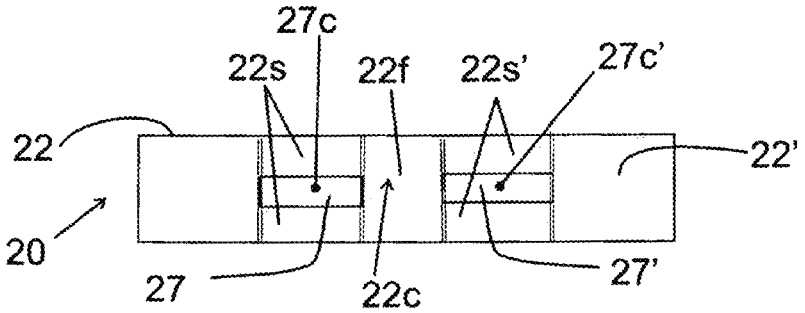
FIG. 7*b* is an overhead view of a top side of the adapter's housing illustrating the approximate size and position of the sockets that receive the pronged terminals fitted with articulatable extensions.
Figure 7C:
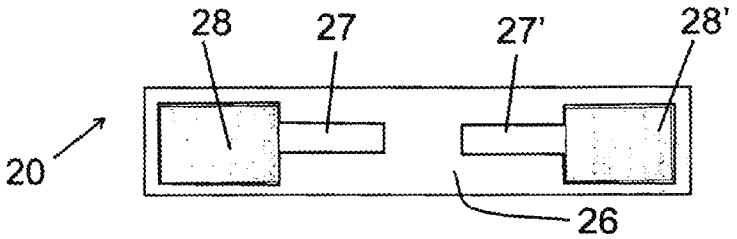
FIG. 7*c* is a plan view of a bottom side of the adaptor's electrical insulating chute shaped housing illustrating the accessible open cavities.
Figure 7D:
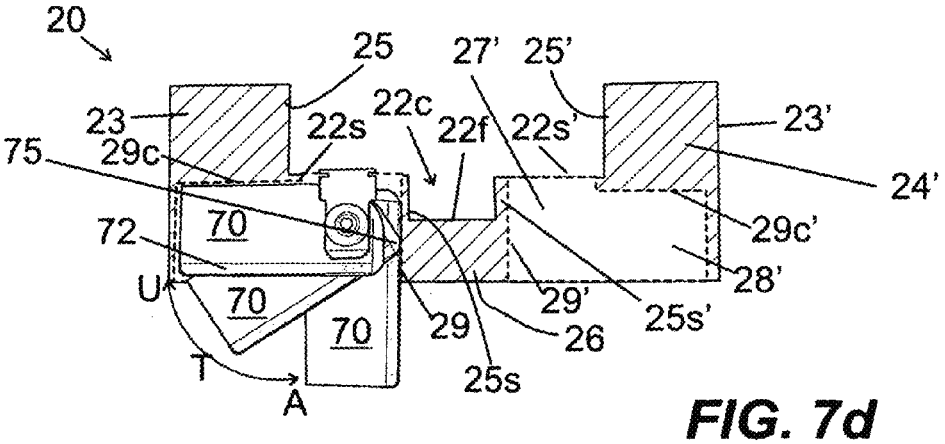
FIG. 7*d* is a cross-sectional view of the chute shaped housing, taken along sectional line 7*d*-7*d* of FIG. 7*a*, illustrating how the pivoting action transitions (T) from an assembly position (A) to a use position (U) places positions articulatable extensions in the accessible open cavity and the action effectively locks the modified circuit breaker on the housing.

The adaptor's electrical insulating chute shaped housing 20 is illustrated in FIG. 7*a*. The housing 20 insulates and supports the modified circuit breaker 51 (not shown-see FIG. 6*b*). The housing has a left top side 22, a right top side 22', a left end side 23, a right end side 23', a bottom side 26, a center chute shaped section that includes a chute section's right side 25', a chute section's left side 25, a right ledge 22*s'*, a left ledge 22*s*, a channel section having a lower second right side 25*s'*, a lower second left side 25*s*, and a floor 22*f*. As shown in FIGS. 7*c* and 7*d*, the housing has accessible open cavities (left cavity 28 and a right cavity 28'), where the right cavity 28' is shown in FIG. 7*d*.

The modified circuit breaker 51 is attached by simply plugging the pronged terminals fitted with extensions (see FIG. 6*a*) into sockets. The sockets 27,27' are shown in FIG. 7*b*. The center points of the sockets 27*c*,27*c'* are labeled. The sockets are located in the ledges 22*s*,22*s'*, and the sockets are sufficiently large to accommodate the terminals with fastened extensions.

The sockets extend to the accessible open cavities 28,28', as shown in the plan view of the bottom 26 side of the housing 20. The cavities 28,28' are sufficiently large to accommodate the springedly widened clips 111*c*, 112*c* gripping the articulable extensions 70,70' in the use position.

Rotation of the extensions 70,70' and one of the cavities 28' is shown in FIG. 7*d*, which is a cross-sectional view of the housing, taken along sectional line 7*d*-7*d* of FIG. 7*a*. The FIG. 7*d* illustrates how the pivoting action from the assembly position (A) through transitions (T) to the use position (U). The action effectively locks the modified circuit breaker 51 on the housing 20. As may be easily seen, once in the use position the tapered edge 72 is ready to engage a clip. The extension cannot rotate any further as the end of the extension 76 limits movement as does the ceiling 29*c*,29*c'* of the cavities. Once engaged with the clips 111*c*, 112*c*, the springedly tensioned clips restrain any further movement. The adapter 10 is secured in a fused holder and the modified circuit breaker 51 is in electrical contact through the extensions 70, 70', which are secured in the clips 111*c*, 112*c*. The clips 111*c*, 112*c* are individually and completely surrounded by an insulating housing. The housing may be made of Nylon® or other suitable material.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A circuit breaker adapter for use in a fuse holder having at least one pair of gripping clips, comprising:

a modified circuit breaker including at least two pronged terminals, wherein a first pronged terminal comprises a pivotally attached first arcuate conductive articulable extension, and a second pronged terminal comprises a pivotally attached second arcuate conductive articulable extension;

a housing comprising an insulating and supportive contiguous block of material for receiving the modified circuit breaker and said at least one pair of gripping clips of the fuse holder, wherein said housing comprises a left top side, a right top side, a left end side, a right end side, a bottom side, and center chute shaped section, which includes a right side, a left side, a right ledge, a left ledge, a lower channel with a lower second right side, a lower second left side, a floor, and a pair of accessible open cavities inside the housing, wherein each of the pair of accessible open cavities is configured to receive, respectively, a gripping clip of said at least one pair of gripping clips, to grip one of the first articulable extension and the second articulable extension, wherein a right socket on the right ledge and a left socket on the left ledge respectively receive the pivotally attached first arcuate conductive articulable extension and the pivotally attached second arcuate conductive articulable extension, wherein both said extensions are rotated outboard into one of the accessible open cavities, and wherein an inboard corner of each of the extensions is rounded to permit rotation of each of said both said extensions and avoid impingement of the modified circuit breaker.

2. The circuit breaker adapter according to claim 1, wherein each of the first arcuate conductive articulable extension and the second arcuate conductive articulable extension includes a taped edge.

3. The circuit breaker adapter according to claim 1, wherein said block of material is comprised of Nylon®.

4. The circuit breaker adapter according to claim 1, wherein each of the first arcuate conductive articulable extension and the second arcuate conductive articulable extension is comprised of brass.

5. The circuit breaker adapter according to claim 1, wherein the modified circuit breaker is positioned in the chute shaped section seated on the left ledge and the right edge, and wherein the modified circuit breaker extends from the chute shaped section's left side to the chute shaped section's right side.

6. The circuit breaker adapter according to claim 1, wherein a first pivotal attachment of the first arcuate conductive articulable extension to one of said at least two pronged terminals comprises a first rivet, and wherein a second pivotal attachment of the second arcuate conductive articulable extension to one of said at least two pronged terminals comprises a second rivet.

7. A circuit breaker adapter for use in a fuse holder with at least one pair of gripping clips, comprising:

a modified circuit breaker having two pronged terminals, wherein a first pronged terminal comprises a pivotally attached first arcuate conductive articulable extension, and a second pronged terminal comprises a pivotally attached second arcuate conductive articulable extension;

a housing comprising an insulating and supportive contiguous block of material for receiving the modified circuit breaker and said at least one pair of gripping clips of the fuse holder, wherein said housing comprises a left top side, right top side, a left end side, a right end side, a bottom side, and center chute shaped section, which includes a right side, a left side, a right ledge, a left ledge, a lower channel with a lower second right side, a lower second left side, a floor, and a pair of accessible open cavities inside the housing, wherein each of the pair of accessible open cavities is configured to receive, respectively, a gripping clip of said at least one pair of gripping clips, to grip one of the first articulable extension and the second articulable extension, wherein a right socket on the right ledge and a left socket on the left ledge respectively receive the pivotally attached first arcuate conductive articulable extension and the pivotally attached second arcuate conductive articulable extension, wherein both said extensions are rotated outboard into one of the accessible open cavities, and wherein an inboard corner is rounded on said both said extensions to permit rotation of said both said extensions and avoid impingement of one of the modified circuit breaker, a socket wall, and an inboard accessible open cavity.

8. The circuit breaker adapter according to claim 7, wherein each of said both said extensions include a tapered edge.

9. The circuit breaker adapter according to claim 7, wherein said block of material is comprised of Nylon®.

10. The circuit breaker adapter according to claim 7, wherein said both said extensions are comprised of brass.

11. The circuit breaker adapter according to claim 7, wherein the modified circuit breaker positioned in center chute shaped section is seated on the left ledge and on the right edge, and wherein the modified circuit breaker extends from the left side to the right side of the center chute shaped section.

12. The circuit breaker adapter according to claim 7, wherein a first pivotal attachment of the first arcuate conductive articulable extension to one of said two pronged terminals comprises a first rivet.

13. The circuit breaker adapter according to claim 7, wherein the housing includes a first width comparable to a second width of a single bay on a multiple bay fuse holder.

14. The circuit breaker adapter according to claim 7, wherein the housing includes a first overall length longer than a second overall length of the fuse, which is replaced.

15. A circuit breaker adapter for use in a fuse holder with at least one pair of gripping clips, comprising:

a modified circuit breaker having at least two flat pronged terminals, wherein a first flat pronged terminal comprises a pivotally attached first arcuate conductive articulable flat extension, and a second flat pronged terminal comprises a pivotally attached second arcuate conductive articulable flat extension;

a housing comprising an insulating and supportive contiguous block of material for receiving the modified circuit breaker and said at least one pair of gripping clips of the fuse holder, wherein said housing comprises a left top side, a right top side, a left end side, a right end side, a bottom side, and center chute shaped section, which includes a right side, a left side, a right ledge, a left ledge, a lower channel with a lower second right side, a lower second left side, a floor, and a pair of accessible open cavities inside the housing, wherein each of the pair of accessible open cavities is configured to receive, respectively, a gripping clip of said at least one pair of gripping clips, to grip one of the first articulable flat extension and the second articulable flat extension, wherein a right socket on the right ledge and a left socket on the left ledge respectively receive the pivotally attached first arcuate conductive articulable flat extension and the pivotally attached second arcuate conductive articulable flat extension, wherein both said extensions are rotated outboard into one of the accessible open cavities, and wherein an inboard corner is rounded on both extensions to permit rotation of said both extensions and avoid impingement of the modified circuit breaker, and wherein said inboard corner is rounded on said both extensions to permit rotation of said both extensions and avoid impingement of a wall defined by sockets and an inboard cavity wall.

16. The circuit breaker adapter according to claim 15, wherein a reset button on the modified circuit breaker is configured to be tripped when a current overage occurs.

17. The circuit breaker adapter according to claim 16, wherein a tripped reset button is resettable independent of a need to one of remove the circuit breaker adapter and cut off a power source.

18. The circuit breaker adapter according to claim 15, wherein the circuit breaker adapter is configured for use on at least one a vessel.

19. A circuit breaker adapter for use in a fuse holder having at least one pair of fasteners, comprising:

a modified circuit breaker including at least two pronged terminals, wherein a first pronged terminal comprises a pivotally attached first arcuate conductive articulable extension, and a second pronged terminal comprises a pivotally attached second arcuate conductive articulable extension;

a housing comprising an insulating and supportive contiguous block of material for receiving the modified circuit breaker and said at least one pair of fasteners of the fuse holder, wherein said housing comprises a left top side, a right top side, a left end side, a right end side, a bottom side, and center chute shaped section, which includes a right ledge, a left ledge, a floor, and a pair of accessible open cavities inside the housing, wherein each of the pair of accessible open cavities is configured to receive, respectively, a fastener of said at least one pair of fasteners, to hold one of the first articulable extension and the second articulable extension, wherein a right socket on the right ledge and a left socket on the left ledge respectively receive the pivotally attached first arcuate conductive articulable extension and the pivotally attached second arcuate conductive articulable extension, wherein both said extensions are rotated outboard into one of the accessible open cavities, and wherein an inboard corner of each of the extensions is rounded to permit rotation of each of said both said extensions and avoid impingement of the modified circuit breaker.

20. The circuit breaker adapter of claim 19, wherein center chute shaped section comprises a right side, a left side, a lower channel with a lower second right side, and a lower second left side.

* * * * *